United States Patent [19]

Jackson

[11] 4,140,427

[45] Feb. 20, 1979

[54] PILE WITH RIGID PLATE

[76] Inventor: Gary A. Jackson, 4565 W. Donges La., Milwaukee, Wis. 53223

[21] Appl. No.: 848,281

[22] Filed: Nov. 3, 1977

[51] Int. Cl.[2] ..... E02D 5/22

[52] U.S. Cl. ..... 405/231; 405/244; 405/253; 52/153; 52/170

[58] Field of Search ..... 61/39, 53.68, 53, 49, 61/35, 58; 52/153, 154, 155, 170

[56] References Cited

U.S. PATENT DOCUMENTS

| | | | |
|---|---|---|---|
| 1,198,117 | 9/1916 | Dusang | 52/153 |
| 1,422,301 | 7/1922 | Parker | 52/153 X |
| 3,466,874 | 9/1969 | Holl | 61/39 |
| 4,028,900 | 6/1977 | Müller | 61/53.68 |

FOREIGN PATENT DOCUMENTS

| | | | |
|---|---|---|---|
| 4648 | 12/1920 | Netherlands | 61/53 |

*Primary Examiner*—Jacob Shapiro

*Attorney, Agent, or Firm*—Michael, Best & Friedrich

[57] ABSTRACT

Disclosed herein is a pile including an elongate member having a front surface, a back surface and a lower end portion adapted to be driven into the earth. A rigid plate is transversely affixed on the lower end portion of the elongate member. When the elongate member is driven generally upright into the earth, the plate extends through the earth in a direction generally perpendicular to lateral forces acting on the front or back surface of the elongate member. The pile can be used as an upright support member for an earth embankment wall.

8 Claims, 5 Drawing Figures

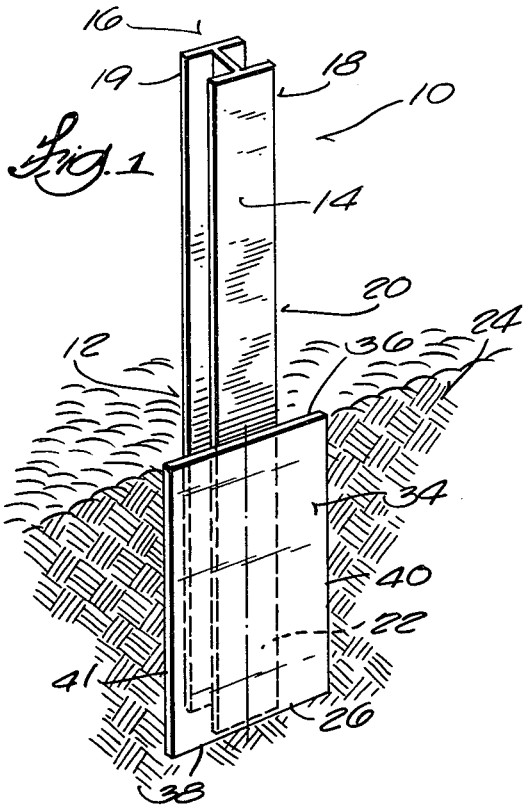
Fig. 1
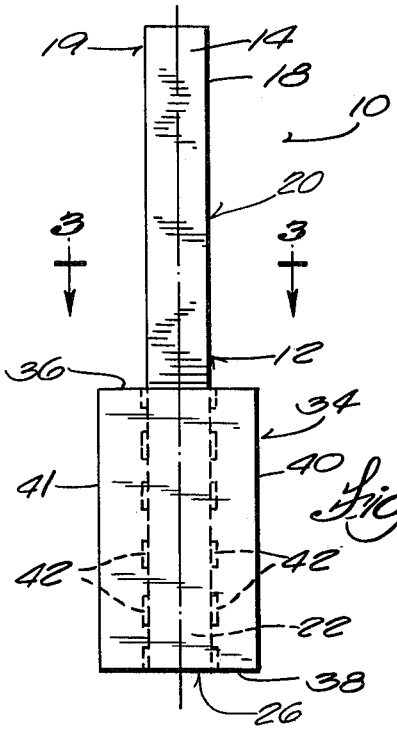
Fig. 2
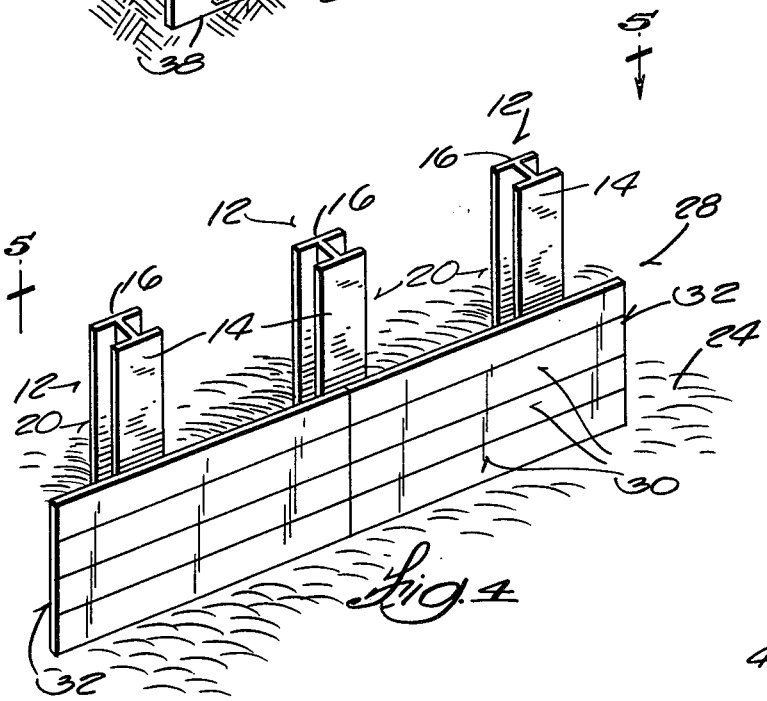
Fig. 4
Fig. 3
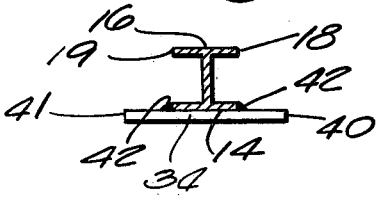
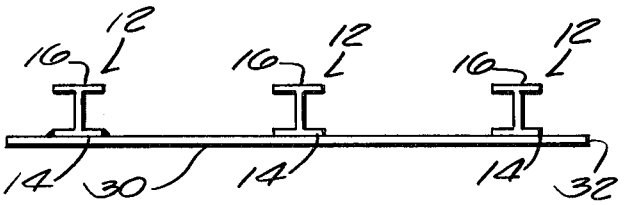
Fig. 5

PILE WITH RIGID PLATE

BACKGROUND OF THE INVENTION

The invention relates generally to piles driven into the ground at construction sites to form the upright support members of earth embankment walls. More particularly, the invention relates to the use of a rigid plate affixed to the underground portion of an upright support pile to increase the safe bearing power of the pile.

Typically, a plurality of upright piles are driven into the earth and positioned to be generally spaced along the edges of an earth embankment. A portion of each pile extends above the earth. A plurality of suitable support members, often sections of lumber, are transversely attached to the above-ground portion of the upright piles to form a retaining wall. The safe bearing power of each pile is a functon of the structural strength of the pile and the depth of its penetration into the earth. The lateral forces exerted against the pile can exceed the safe bearing power of the pile. As a result, the pile is either structurally deformed or caused to shift laterally through the earth. Both results undermine the strength and integrity of earth embankment walls.

SUMMARY OF THE INVENTION

The invention provides a pile adapted for use as a support member in earth embankment walls. The pile includes an elongate member having an upper portion and a lower end portion. The elongate member is adapted to be driven generally upright into the earth, with the upper portion extending above the ground and the lower end portion located in the earth. The member further includes a front surface, a back surface and transversely spaced outer side edges.

The pile further comprises a transversely extending rigid plate affixed on the lower end portion of the elongate member. The rigid plate includes end edges, each extending beyond the corresponding outer side edges of the elongate member. After being driven into the earth along with the lower end portion of the elongate member, the rigid plate is adapted to extend through the earth in a generally perpendicular direction relative to lateral forces acting on the front or back surfaces of the elongate member, which lateral forces tend to laterally displace the member through the earth.

In a preferred embodiment, the pile is of H-beam shape having a web separating a pair of opposed flanges, and the rigid plate is affixed to the surface of one of the flanges.

In another embodiment, the rigid plate is transversely affixed to the lower end portion of the pile so that the lower transverse edge of the rigid plate is aligned with the tip of deepest penetration of the lower end portion of the elongate member.

In another embodiment, the rigid plate is transversely affixed to the lower end portion of the elongate member so that the longitudinal axis of the rigid plate is generally aligned along the longitudinal axis of the lower end portion of the elongate member.

One of the principal features of the invention is the provision of a pile to which a rigid plate is affixed to improve the pile's safe bearing power.

Another feature of the invention is the provision of a plurality of piles with rigid plates that form the upright support members of an earth embankment wall, thereby improving the strength and intergrity of an earth embankment wall.

Other features and advantages of the invention will become known by reference to the following description, claims and accompanying drawings.

DESCRIPTION OF DRAWINGS

FIG. 1 is a perspective view of a pile embodying various of the features of the invention;

FIG. 2 is an elevation view of the pile in FIG. 1;

FIG. 3 is a sectional view taken generally along line 3—3 in FIG. 2;

FIG. 4 is a perspective view of a conventional earth embankment wall using a plurality of the piles of FIG. 1 as upright supports; and FIG. 5 is a plan view taken generally along line 5—5 in FIG. 4.

Before explaining the invention in detail, it is to be understood that the invention is not limited in its application to the details of construction and arrangement of parts set forth in the following general description or illustrated in the accompanying drawings, since the invention is capable of other embodiments and of being practiced or carried out in various ways. Also, it is to be understood that the phraseology and terminology employed herein is for the purpose of description and not of limitation.

GENERAL DESCRIPTION

Shown in FIG. 1 is a pile 10 which embodies various of the features of the invention. The pile includes an elongate member 12 having a front surface 14, a back surface 16, transversely spaced outer side edges 18 and 19, and a longitudinal axis centered between the outer side edges 18 and 19. The elongate member 12 also has an upper portion 20 and a lower end portion 22. The member 12 is adapted for being driven generally upright into the earth 24, with the upper portion 20 extending above the earth 24 and the lower end portion 22 located in the earth 24. The tip of deepest penetration of the elongate member in the earth defines a lower transverse edge 26 of the elongate member.

While the elongate member 12 can be made of various materials and take various forms, in the illustrated and preferred construction, it is made from steel and has an H-beam shape with flanges which define the front 14 and back 16 surfaces.

After being driven into the earth 24, the elongate member 12 is subject to lateral forces that tend to laterally displace the member through the earth 24. To maximize the resistance of the member 12 to lateral displacement, conventionally called the member's bearing capacity, the member 12 is normally positioned in the earth so that the lateral forces act on the member 12 in a direction generally perpendicular to the front 14 or back 16 surfaces of the member 12.

The conventional use of the elongate member 12 is shown in FIG. 4, in which a plurality of elongate members 12 are driven into the earth 24 in spaced relationship to form the upright support members of an earth embankment wall 28. A plurality of suitable transverse support members 30 are affixed to the front surface 14 of the upper portion 20 of the elongate members 12, thereby defining the upright support surface 32 of the embankment wall 28. To maximize the bearing power of the embankment wall 28, the elongate members 12 and transverse support members 30 are conventionally aligned as illustrated in FIG. 5, so that the lateral forces act in a direction generally perpendicular to the back surface 16 of the elongate members 12 and the upright surface 32 the transverse members 30.

In accordance with the invention, the bearing capacity of the elongate member 12 is increased by affixing a transversely extending, rigid plate 34 on the end portion 22 thereof. While the rigid plate 34 can be made of various materials and take various forms, in the illustrated construction it is made from steel and is rectangular, having upper and lower transverse edges 36 and 38, transversely spaced outer side edges 40 and 41, and a longitudinal axis centered between the outer side edges 40 and 41. As shown in FIG. 2, the transverse dimension of the rigid plate 34 exceeds the transverse dimension of the lower end portion 22 of the elongate member 12, while the upright dimension of the rigid plate 34 approximates the depth which the lower end portion 22 is to be driven into the earth.

The rigid plate 34 is positioned so that each of the outer side edges 40 and 41 of the rigid plate 34 extends beyond each of the respective outer side edges 18 and 19 of the lower end portion 22. While the rigid plate 34 can be affixed to the lower end portion 22 in various configurations, in the illustrated embodiment, the lower transverse edge 38 of the rigid plate 34 is generally aligned with the lower transverse edge 26 of the lower end portion 22 and the longitudinal axis of the rigid plate 34 is generally aligned with the longitudinal axis of the lower end portion 22. The rigid plate 34 can be affixed on either the front 14 or back 16 surface flange of the H-beam.

While various suitable means can be used for affixing the rigid plate 34 on the elongate member 12, in the illustrated construction such means comprises a plurality of skip welds 42 spaced along the intersection between the rigid plate 34 and the lower end portion 22 of the elongate member 12. If desired, the rigid plate 34 and the member 12 may be adapted so that suitable fastening means, such as bolt or rivets, can be used.

The elongate member 12 with rigid plate 34 is driven in a generally upright position into the earth 24 with the rigid plate 34 extending through the earth 24 in a direction generally perpendicular to lateral forces acting on the front 14 or back 16 surface of the elongate member 12.

A plurality of the elongate members 12 with rigid plates 34 are driven into the earth in spaced relationship, with each plate 34 aligned generally perpendicularly to the direction of lateral forces acting on the front 14 or back 16 surface of the elongate member 12, thereby providing the upright support members for an earth embankment wall 28. A plurality of suitable transverse support members 30 can be affixed to the upper end portions 20 of an elongate members 12 to complete the embankment wall 28.

Various of the features of the invention are set forth in the following claims.

I claim:

1. A pile adapted for use as a support for an earth embankment wall, which pile comprises an elongate member having an upper portion and a lower end portion and being adapted to be driven generally upright into the earth with said upper portion extending above the earth and said lower end portion located in the earth, said member further including a front surface having transversely spaced outer side edges, a back surface having transversely spaced outer side edges, and a transversely extending rigid flat plate affixed to one of said surfaces on said lower end portion, said plate having end edges extending respectively beyond said outer side edges of said one surface, said plate being adapted, after being driven into the earth along with said lower end portion, to extend through the earth in a direction generally perpendicular to lateral forces acting on said member in a direction toward said front or back surfaces on said elongate member and tending to laterally displace said member.

2. A pile according to claim 1 wherein said lower end portion of said elongate member includes a lower transverse edge defined by the tip of deepest penetration of said lower end portion into the earth and wherein said rigid plate has a lower transverse edge in general alignment with said lower transverse edge of said rigid plate.

3. A pile according to claim 2 wherein said lower end portion further includes a longitudinal axis centered between said outer side edges, and wherein said rigid plate includes a longitudinal axis centered between said end edges and located in general alignment with said longitudinal axis of said lower end portion.

4. A pile according to claim 3 wherein said elongate member is of H-beam shape and has a web separating said front and back surfaces.

5. An earth embankment wall comprising a plurality of piles generally spaced along an earth embankment to serve as upright support members, each of said piles including an elongate member driven generally upright into the earth, and having a front surface having transversely spaced outer side edges, a back surface having transversely spaced outer side edges, an upper portion extending above the earth and a lower end portion located in the earth, and further including a transversely extending rigid flat plate affixed to one of said surfaces on said lower end portion, and extending through the earth in a direction generally perpendicular to lateral forces acting on said member in a direction toward said front or back surfaces of said elongate member and tending to laterally displace said member, said flat plate having end edges extending respectively beyond said outer side edges of said one surfaces, said embankment wall further including a plurality of transverse support members attached to said upper portion.

6. An earth embankment wall according to claim 5 wherein said elongate member is of H-beam shape and has a web separating said front and back surfaces.

7. An earth embankment wall according to claim 6 wherein said lower end portion of said elongate member further includes a lower transverse edge defined by the tip of deepest penetration of said lower end portion into the earth and said rigid plate has a lower transverse edge in general alignment with said lower transverse edge of said rigid plate.

8. An earth embankment wall according to claim 7 wherein said lower end portion includes a longitudinal axis centered between said outer side edges, wherein said rigid plate includes a longitudinal axis centered between said end edges and located in general alignment with said longitudinal axis of said lower end portion.

* * * * *